United States Patent [19]

Vaughan

[11] Patent Number: 4,933,682

[45] Date of Patent: Jun. 12, 1990

[54] POINT TO POINT MICROWAVE COMMUNICATION SERVICE ANTENNA PATTERN WITH ANULL IN AN INTERERING DIRECTION

[76] Inventor: Thomas J. Vaughan, Box 440, Rye Beach, N.H. 03871

[21] Appl. No.: 416,113

[22] Filed: Sep. 9, 1982

[51] Int. Cl.[5] ..... H01Q 21/08

[52] U.S. Cl. ..... 343/844; 343/853; 342/424

[58] Field of Search ..... 343/794, 758, 844, 853, 343/424, 442, 445, 446, 757

[56] References Cited

U.S. PATENT DOCUMENTS

| | | | |
|---|---|---|---|
| 2,033,271 | 3/1936 | Aiken | 455/105 |
| 2,449,999 | 9/1948 | Heaton-Armstrong | 343/794 |
| 3,212,089 | 10/1965 | Longacre et al. | 343/442 |
| 3,249,943 | 5/1966 | Kaufman | 343/446 |
| 3,257,660 | 6/1966 | Schneider | 343/758 |
| 3,852,754 | 12/1974 | Worrell | 343/424 |
| 3,977,004 | 8/1976 | Bickel | 343/853 |
| 4,304,464 | 12/1981 | Hill et al. | 356/353 |
| 4,397,558 | 8/1983 | Hill et al. | 356/354 |
| 4,415,902 | 11/1983 | Redlich | 343/844 |

*Primary Examiner*—Rolf Hille
*Assistant Examiner*—Michael C. Wimer
*Attorney, Agent, or Firm*—Robert T. Dunn

[57] ABSTRACT

In a point to point microwave communication service including a microwave antenna system at each point directed at the other point, the radiation pattern of the antenna system at at least one point has a substantial null in the direction of an antenna of another microwave communication service to avoid an exchange of signals with the other service, the antenna system provided at said one point includes two antenna elements having substantially equal directional radiation patterns, so oriented and spaced apart a distance that is at least several wave length of the operating frequency of the elements so that the radiation patterns of the elements overlap producing a net radiation pattern that results from interference of the patterns and the net pattern has a substantial lobe in the direction of the other point of said service and a substantial null in the direction of an antenna of the other microwave communication service.

27 Claims, 3 Drawing Sheets

POINT TO POINT MICROWAVE COMMUNICATION SERVICE ANTENNA PATTERN WITH ANULL IN AN INTERERING DIRECTION

BACKGROUND OF THE INVENTION

The present invention relates to stationery ground antenna systems for fixed microwave service where narrow beam transmission from point to point is required and interference with other point to point microwave service is to be avoided. The invention also relates to ground to satellite transmission where a null in the radiation pattern must be placed at an adjacent stationery satellite.

Heretofore, the Federal Communications Commission (FCC) of the United States Government has set forth very strict beam width and side lobe requirements for fixed microwave service from point to point on the ground. In particular, the FCC has specified "Antenna limitations" for fixed point to point ground or ground to satellite microwave service employing directional microwave antennas for transmitting or receiving between one point and another wherein the radiation pattern of the transmitting antenna has a major lobe of radiation directed toward the receiving station at the other point with which it communicates or, if the path employs a passive repeater between the two points, to the center of the repeater reflector. The requirement is that the directional antenna meet performance standards for microwave frequencies in the range extending between 952 MHZ and 15,000 MHZ. These standards require of the transmitter antenna a maximum width to 3 dB points (beam width angle in degrees) and the minimum radiation suppression (in dB) that must be achieved at angles from the center line of the main beam. In other words, the standards insist that side lobes of the transmitting antenna beam pattern at given angles be suppressed.

Clearly, the FCC requirement for directional microwave antennas are intended to reduce possible interference between different point to point pairs of stations. Heretofore, the usual transmitting antenna has comprised a single horn or reflector (dish) and some effort has been made to reduce interference with other stations by making the size very large and/or by shrouding to narrow the beam width of this antenna and reduce side lobe levels. In many situations these efforts have not been satisfactory. Hence, it is one object of the present invention to provide a method and means of providing a microwave antenna system for point to point ground transmission, ground to satellite transmission whereby some of the above mentioned limitations of prior structures and techniques are avoided. It is a particular object to provide a microwave antenna system capable of meeting the above mentioned FCC requirements of maximum beam width in degrees to 3 dB points and minimum radiation suppression at specific angles.

SUMMARY OF THE INVENTION

The present invention incorporates a new technique for discriminating between the beams for different microwave stations by using two antennas at a station as an interferometer, inasmuch as the interference radiation pattern of the two antennas spaced several wave lengths apart from each other will produce a net radiation pattern in which a number of narrow lobes are produced within the primary radiation pattern of each antenna. In particular, if both antennas are identical and in the same plane, the net radiation pattern from the two will exhibit interference nulls that go to substantially zero (typically 30 to 40 dB). Furthermore, by adjusting the spacing of the two antennas, a deep null can be placed at any particular angle where the beam from the undesired station interferes with the beam from the desired station. In addition, the half power beam width of the net radiation pattern defines a beam which is a great deal more narrow than the beam defined by the radiation pattern from either of the two antennas alone.

According to a preferred embodiment of the present invention, as a transmitting antenna system, two substantially identical microwave antennas, which may be a horn and a reflector type, are mounted side by side on a track so that the spacing between the two can be varied and both antennas are fed from a single two way power divider, each over a short transmission line of the same electrical length. In operation, the spacing between the pair of antennas is varied to produce the particular interference pattern desired and the desired narrow main beam with nulls in either side at particular angles.

Some of the advantages of the applicants technique, in addition to producing a narrow main beam to meet FCC requirements and in addition to producing interference nulls in particular directions include the following:

(a) Two small lightweight antennas can be used having a relatively low wind load and yet produce the beam width and directivity of a substantially larger single antenna;

(b) The antenna system is compatible with and can be added to existing microwave station to station transmitter and/or receiver equipment; and (c) In many situations, use of the applicants antenna system allows equivalent transmission at lower power levels.

(d) It can be used with closely spaced interference signals such as two adjacent stationary satellites spaced 3° apart.

(e) The spacing between antenna can be changed to place the interference null on a new satellite if the separation angle will change.

SPECIFIC DESCRIPTION OF EMBODIMENTS OF THE INVENTION

Overlapping directional antenna patterns of adjacent antenna elements that couple to a common transmission line have a net radiation pattern. The present invention incorporates the novel feature of structuring that net radiation pattern so that the pair of antenna elements perform as a directional filter. If the pair of antenna elements are transmitting, then the net radiation pattern is structured to have extreme interference nulls (30 to 40 dB down) in selected directions. Hence, the pair of transmitting antennas perform not only to illuminate a desired target, but also as a directional filter illuminating the desired target, but not illuminating other targets by producing a null in the direction of those other targets.

As a pair of receiving antennas, applying the same principles, the pair also performs as a directional filter. The receiving antennas are blind in the null directions and so, in effect, any signals coming from the null directions are filtered out.

In a point to point or ground to satellite microwave communication system, full advantage of these features of the invention are achieved using a pair of antennas at the transmitting point and a pair at the receiving point. At the transmitting point, the pair of antennas are adjusted, in situs, to direct the principal lobe of their net radiation pattern to the receiving point and the spacing between the pair is adjusted to produce nulls in the direction of other microwave receiving systems and so avoid interfering with those other receiving systems. At the receiving point, the net radiation pattern of the two antennas is adjusted to produce the nulls in the direction of interfering signals from other systems and so, in effect, filter out those undesired signals. Thus, the method and structures of the present invention are readily employed at both the transmission and receiving points of a microwave system to reduce interference of the system with other systems and to reduce interference with other systems. In addition, the advantage of using smaller lightweight antennas having lower wind loading at both points as compared with the single antennas that are normally is gained.

Figure 1:
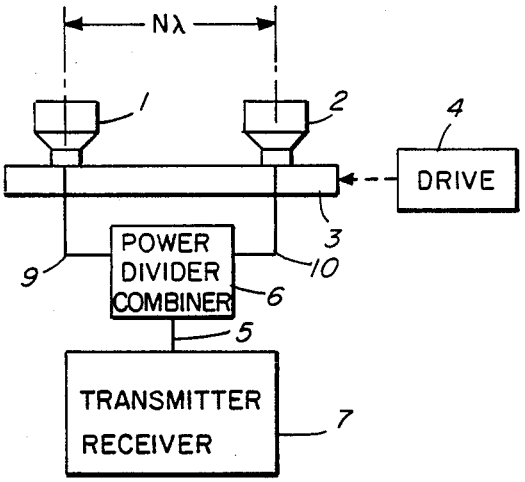
FIGS. 1 and 2 are representative drawings of transmitting or receiving antenna systems incorporating features of the present invention, one utilizing two horn type antennas and the other utilizing two reflector or dish type antennas.
Figure 2:
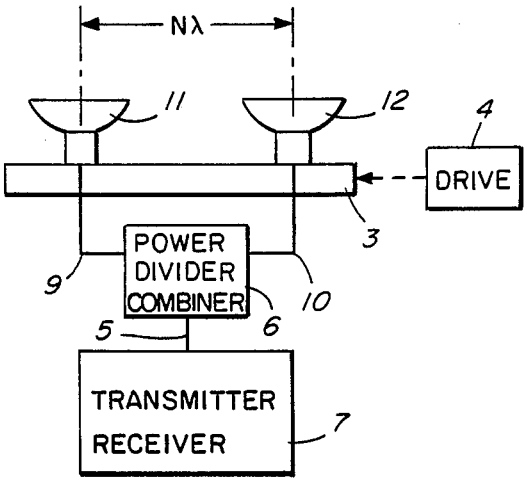
Figure 3:
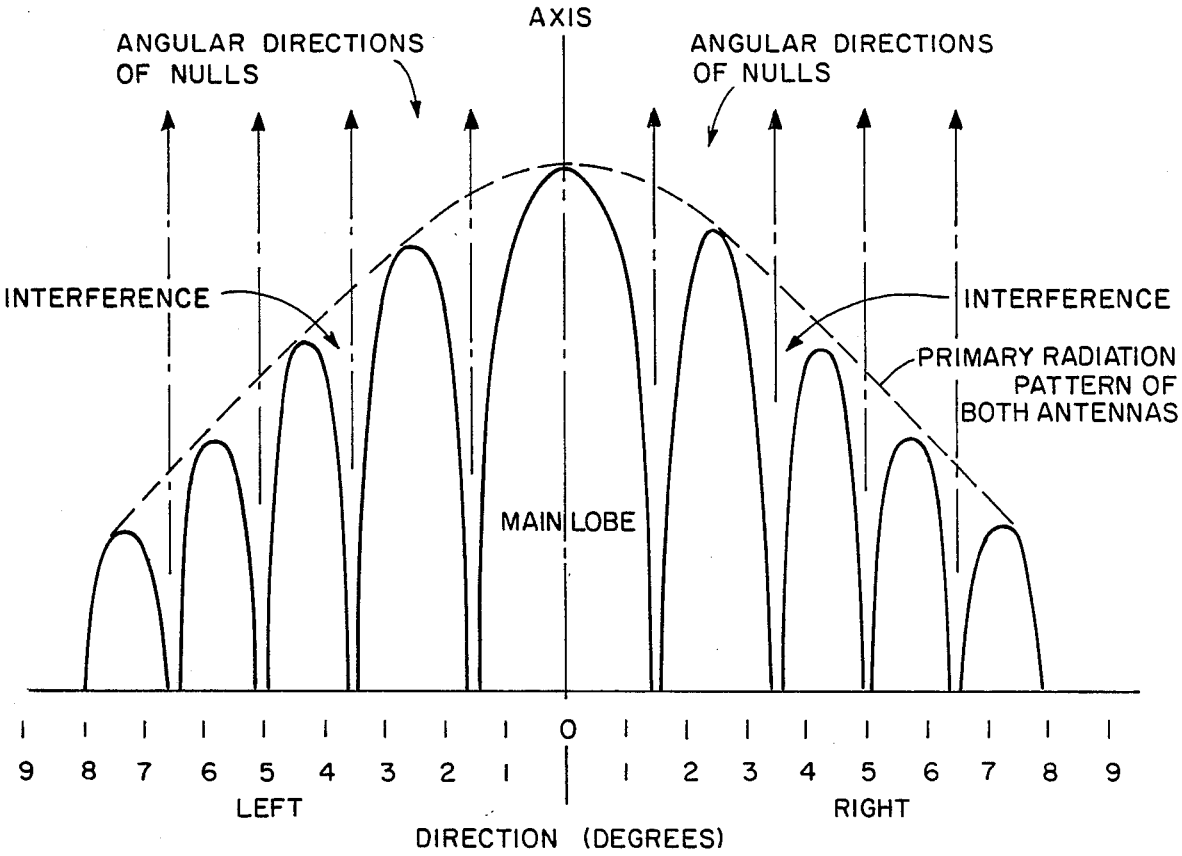
FIG. 3 is a plot of direction angle (left and right of center) illustrating the radiation patterns of the two antennas and their combined or net radiation patterns showing the nulls created by interfering signals.

FIG. 1 and 2 illustrate antenna structures according to the invention. In FIG. 1 the antenna are horns and in FIG. 2 they are dishes. The horns 1 and 2 are mounted on a track 3 so that the spacing between them, N$\lambda$, ($\lambda$is wave length) is variable by moving one or both of the horns along the track. A drive 4 may be provided for varying N$\lambda$. Both of the horns couple to a common transmission line 5 through a power divider or a power combiner 6, depending upon whether the pair are transmitting or receiving pair, and the transmission line couples to a transmitter or a receiver 7 accordingly. In FIG. 2, the only difference illustrated is the use of dish antennas rather than horn antennas and so the two dish antennas 11 and 12 are carried on the track. In a preferred embodiment of these, the two antennas of the pair are substantially identical and they couple to the power divider or combiner 6 by antenna transmission lines 9 and 10 of equal electrical length.

Where both of the antennas in a pair are identical and in the same plane and oriented with their directions parallel as illustrated in FIGS. 1 and 2 and both couple to the common transmission line 5 as described, and the spacing between them is many wave lengths of the operating frequency, they will have a net radiation pattern such as represented by FIG. 3. The pattern is represented as a plot of azimuth angle in degrees left and right of the main lobe versus power. The net radiation pattern of the two antennas is an interference pattern having a number of narrow lobes within the primary radiation pattern of each antenna and between the lobes will be interference nulls that go to substantially zero. By varying the spacing between the two antennas (varying N) the nulls can be placed at desired angles to avoid launching interfering signals at those angles if the system is transmitting, or to avoid receiving interfering signals from those angles if the system is receiving. Also, the half power point of the main lobe will be very narrow, or at least more narrow than the half power width of either antenna alone or a larger antenna.

Listed below are some half power beam widths of equivalent horn type and reflector type pairs of antennas used according to the present invention, at 7 GHz for several different spacings between the antennas of the pair. Also listed is the half power beam width of a single one of the horns and a single one of the reflectors and, for some of the pairs, an equivalent single reflector diameter is calculated.

| | Spacing S to | Beam Width | Equivalent Reflector Size |
|---|---|---|---|
| Single Horn | — | 20° | — |
| Dual Horn | 6" | 8° | 15" |
| Dual Horn | 16.8" | 3° | 40" |
| Dual Horn | 33.6" | 1.8° | 70" |
| Single Reflector | — | 5° | — |
| Dual Reflector | 25" | 1.8° | 66" |
| Dual Reflector | 52" | 1.0° | 120" |

From the above table it can be seen that a pair of 2 ft. diameter reflectors spaced 52 in. apart will have a half power beam width of a 10 ft. diameter reflector. It can be noted that the power received in the main beam will be twice the gain of a single antenna regardless of the spacing, less the loss in the coupling lines. However, this reduction in gain is quite acceptable since high interference environments are not usually gain limited.

Figure 4:
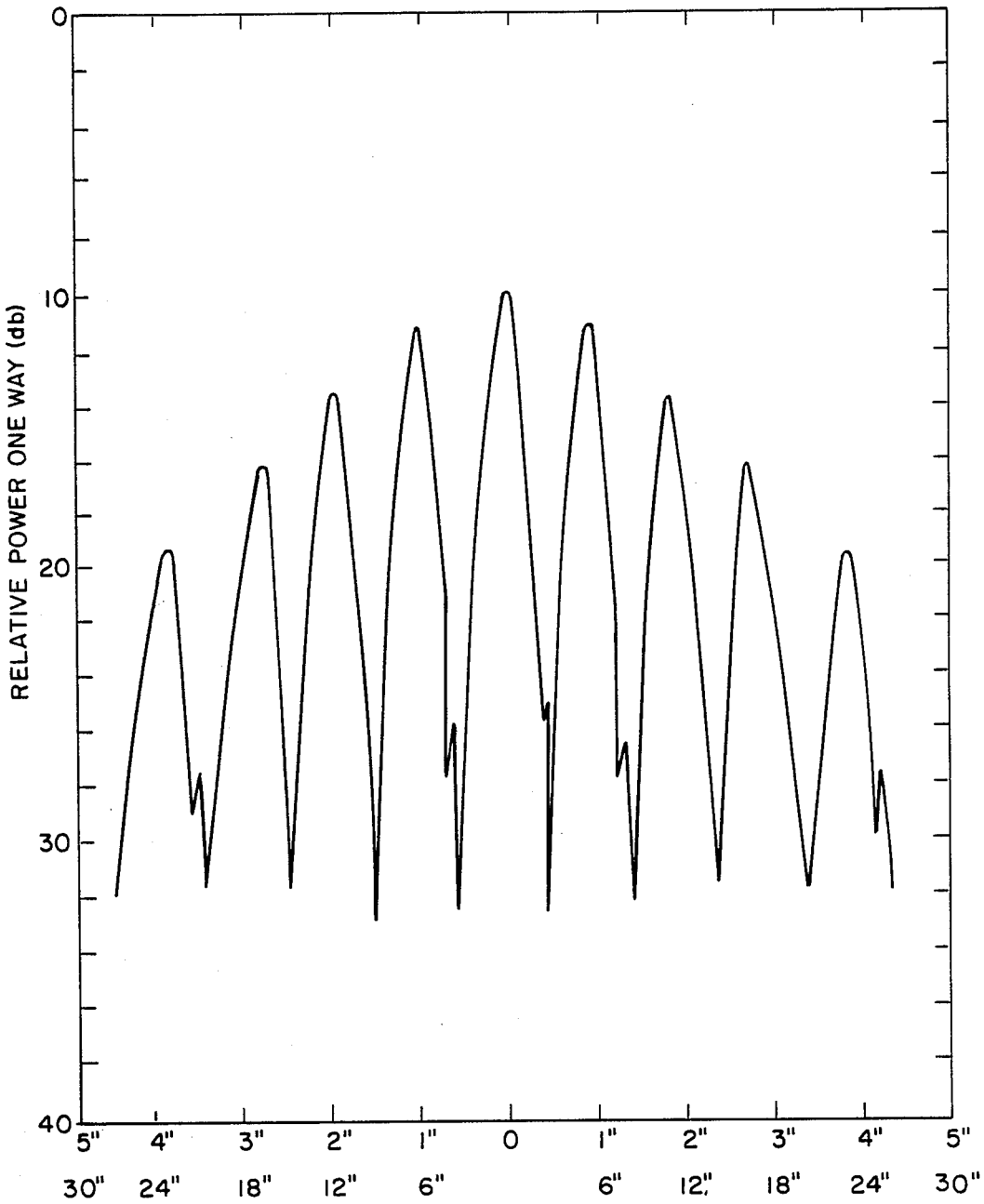
FIG. 4 is a plot of direction angle versus relative power (dB) for dual horn antennas such as shown in FIG. 1*a*, operating at 7 GHz where spacing between the horns is 15 wave lengths.

The interference pattern for a pair of 93101 horns operating at 7 GHz where the horns are spaced 15$\lambda$ apart is represented by a plot of azimuth angle left and right of center versus relative power in FIG. 4. It clearly shows that very deep nulls are produced at about 1½degrees, 2½degrees, etc., both left and right.

Figure 5:
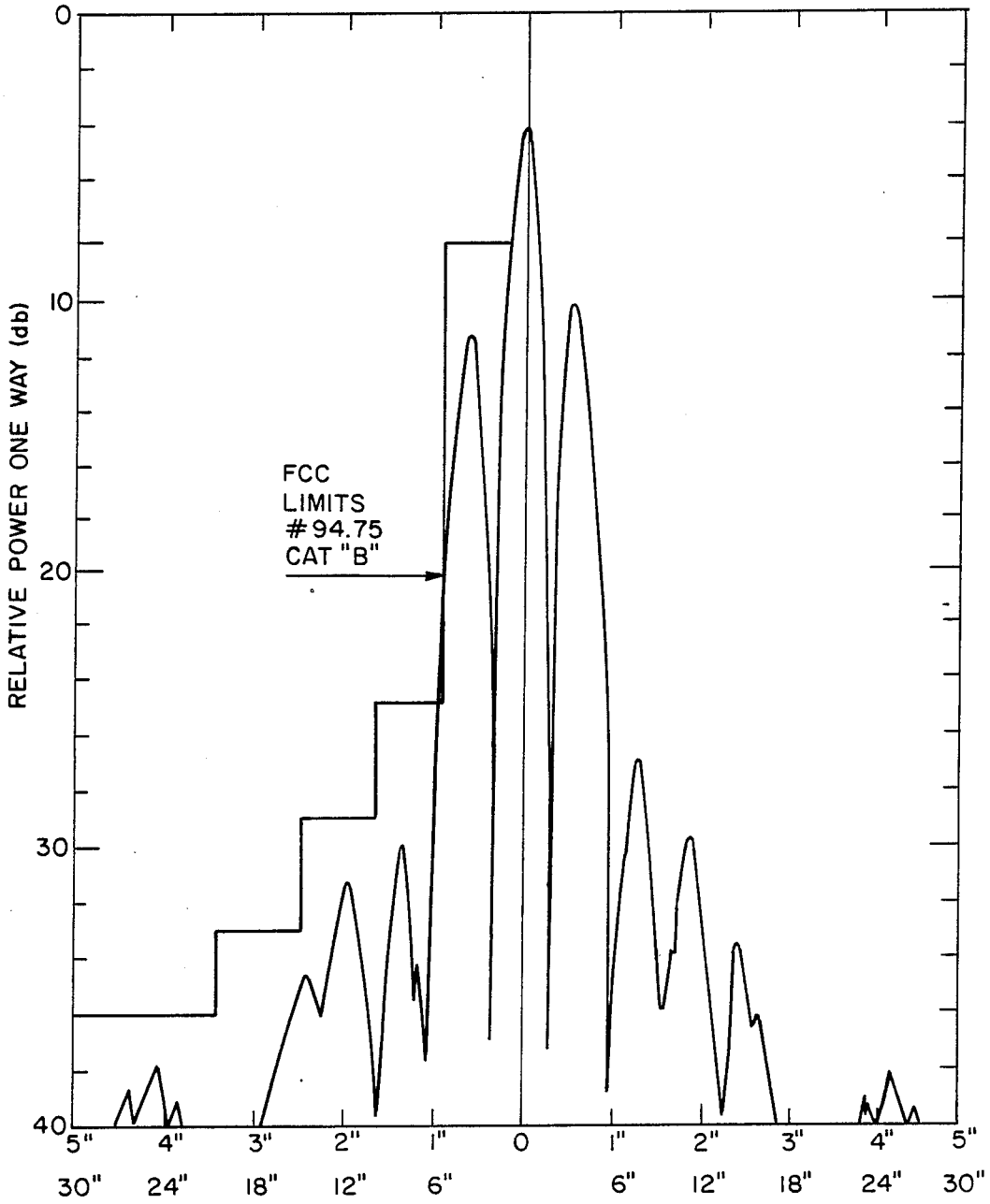
FIG. 5 is a plot of direction angle versus relative power (dB) for two reflective type (dish) antennas each two foot in diameter operating at 7 GHz, spaced 15 wave lengths apart.

The interference pattern for a pair of 93201 reflectors (2 ft. diameter) operated at 7 GHz and spaced apart 15$\lambda$ is represented by FIG. 5. This is also a plot of azimuth angle left and right of center versus relative power. Here, not only are deep nulls produced and the half power width of the central lobe is narrowed, but even the peaks of the side lobes are well within FCC limits as those limits are set forth in Section 94.75 of FCC regulations 72.

The several detailed embodiments of the present invention are described with respect to the specific antenna structures operating at 7 GHz inasmuch as these are deemed to be representative of the 2EH, 12EH and 13EHZ bands and demonstrate a use of the invention. Obviously, modifications and variations are possible, all within the scope of the teachings herein and, therefore, it should be understood that within the scope of the appended claims, the invention may be practiced otherwise than as specifically described by these embodiments.

What is claimed is:

1. In a point to point microwave radiation communication service including a microwave antenna system at each point directed toward the other point wherein the radiation pattern of the antenna system at at least one of said points is such that the said antenna system does not exchange signals by radiaition with an antenna of another microwave communication service, the improvement, comprising an antenna system at at least one point of said service including:

(a) two antenna elements having overlapping directional radiation patterns that each defines a pattern axis parallel to the line from said one point to the other point of said service, (b) means for holding said antenna elements at positions such that their radiation pattern axes are in the same direction and spaced apart a distance that is N wave lengths of the operating frequency of said system, where N is greater than one, (c) a common transmission line, (d) means for coupling each of said antenna elements to said common transmission line and (e) a microwave transmitter or receiver coupled to the common transmission line, (f) said spaced apart distance of N wavelengths being such that said radiation patterns of said antenna elements overlap and interfere and the resulting net radiation pattern has a principal lobe along said line from said one point to the other point and a deep null in the direction of said antenna of said other microwave communication service, (g) whereby said antenna system transmitter or receiver does not transmit radiated signals to or receive radiated signals from said antenna of another microwave communication service.

2. A microwave antenna system as in claim 1 wherein said antenna elements are located on a line perpendicular to their said axes.

3. A microwave antenna system as in claim 1 wherein means are provided for varying N.

4. A microwave antenna system as in claim 1 wherein said antenna elements are identical.

5. A microwave antenna system as in claim 3 wherein said antenna elements are identical.

6. A microwave antenna system as in claim 1 wherein said means for coupling each of said antenna elements to said common transmission line includes antenna element transmission lines that are equal in length.

7. A microwave antenna system as in claim 1 wherein said antenna elements each include a parabolic reflecting dish so that each element has a narrow beam radiation pattern.

8. A microwave antenna system as in claim 1 wherein said antenna elements each include a horn type antenna so that each element has a narrow beam radiation pattern.

9. A microwave antenna system as in claim 7 wherein said antenna element parabolic reflecting dishes are identical.

10. A microwave antenna system as in claim 7 wherein said horn type antenna elements are identical.

11. A microwave antenna system as in claim 2 wherein said means for coupling each of said antenna elements to said common transmission line and said common transmission line are such that the electrical length of transmission line from each of said elements to said transmitter or receiver are equivalent.

12. A microwave antenna system as in claim 2 wherein said means for coupling each of said antenna elements to said common transmission line and said common transmission line are such that the electrical length of transmission line from each of said elements to said transmitter or receiver are the same.

13. A microwave antenna system as in claim 2 wherein said antenna elements each include a parabolic reflecting dish so that each element has a narrow beam radiation pattern and said means for coupling each of said antenna elements to said common transmission line and said common transmission line are such that the electrical length of transmission line from the focal point of each of said parabolic reflecting dishes to said transmitter or receiver are equivalent.

14. A microwave antenna system as in claim 2 wherein said antenna elements each include a parabolic reflecting dish so that each of said elements has a narrow beam radiation pattern and said means for coupling each of said antenna elements to said common transmission line and said common transmission line are such that the electrical length of transmission line from the focal point of each of said parabolic reflecting dishes to said transmitter or receiver are the same.

15. In a point to point microwave radiation communication service in which it is desired that the radiation pattern from one of said points has a substantial null in the direction of an antenna of another microwave radiation communication service, the method of providing a microwave radiation pattern at at least one of said points that includes a relatively narrow central lobe along the line between said points and a substantial null in the direction of said antenna of said other service, including the steps of:

(a) providing two side by side antenna elements at said one point of said service each having a directional radiation pattern that each defines a pattern axis parallel to the line from said one point to the other point of said service and (b) varying the spacing between said two side by side antenna elements to vary the angular direction of an interference null of the combined radiation pattern of said two elements while said elements are coupled to a common transmission line so that said null is in the direction of said antenna of said other service.

16. A method as in claim 15 wherein said step of providing two side by side antenna elements provides said elements located on a common line that is perpendicular to said pattern axes.

17. A method as in claim 16 wherein said step of providing two side by side antenna elements located on a common line that is perpendicular to said pattern axes provides said elements on opposite sides of said line from said one point to said other point.

18. A method as in claim 16 wherein said common transmission line is coupled to a transmitter or receiver and said coupling of said antenna elements to said common transmission line and said common transmission line are such that the electrical length of transmission line from each of said elements to said transmitter or receiver are equivalent.

19. A method as in claim 16 wherein said common transmission line is coupled to a transmitter or receiver and said coupling of said antenna elements to said common transmission line and said common transmission line are such that the electrical length of transmission line from each of said elements to said transmitter or receiver are the same.

20. A method as in claim 16 wherein each of said antenna elements includes a parabolic reflecting dish so that each of said elements has a narrow beam radiation pattern and said common transmission line is coupled to a transmitter or receiver and said coupling of said antenna elements to said common transmission line and said common transmission line are such that the electrical length of transmission line from the focal point of each of said parabolic reflecting dishes to said transmitter or receiver are the same.

21. In a point to point microwave radiation communication service including a microwave antenna system at each point directed toward the other point wherein the radiation pattern of the antenna system at at least one of said points is such that said antenna system at said one point does not receive signals by radiation from or transmit signals by radiation in a predetermined direction, the improvement, comprising an antenna system at said one point of said service including:

(a) two antenna elements having overlapping directional radiation patterns that each defines a pattern axis parallel to the line from said one point to the other point of the service, b) means for holding said antenna elements at positions such that their radiation pattern axes are in the same direction and spaced apart a distance that is N wave lengths of the operating frequency of said system, where N is greater than one, (c) a common transmission line, (d) means for coupling each of said antenna elements to said common transmission line and (e) a microwave transmitter or receiver coupled to said common transmission line, (f) the spaced apart distance of N wavelengths being such that said radiation patterns of said antenna elements overlap and interfere and the resulting net radiation pattern of both of said antenna elements has a principal lobe along said line from said one point to the other point and a deep null in said predetermined direction, (g) whereby said antenna system receiver or transmitter does not receive signals by radiation from or transmit signals by radiation in said predetermined direction.

22. A microwave antenna system as in claim 21 wherein said antenna elements are located on a line perpendicular to their said axes.

23. A microwave antenna system as in claim 21 wherein means are provided for varying N.

24. A microwave antenna system as in claim 21 wherein said antenna elements are identical.

25. A microwave antenna system as in claim 23 wherein said antenna elements are identical.

26. A microwave antenna system as in claim 21 wherein said means for coupling each antenna element to said common transmission line includes antenna element transmission lines of equal electrical length.

27. A microwave antenna system as in claim 22 wherein said antenna elements each include a parabolic reflecting dish so that each of said antenna elements has a narrow beam radiation pattern and said means for coupling each of said antenna elements to said common transmission line and said common transmission line are such that the electrical length of transmission line from the focal point of each of said parabolic reflecting dishes to said transmitter or receiver are equivalent.

* * * * *